US006645017B1

(12) United States Patent
Skrzypek et al.

(10) Patent No.: US 6,645,017 B1
(45) Date of Patent: Nov. 11, 2003

(54) MARINE POWERTRAIN AND ACCESSORY POWER SYSTEM WITH FLYWHEEL MOTOR GENERATOR UNIT

(75) Inventors: Mark L. Skrzypek, Chesapeake, VA (US); Stephen Gregory Poulos, Farmington Hills, MI (US); Rick D. Dunagan, Rochester, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/167,002

(22) Filed: Jun. 11, 2002

(51) Int. Cl.[7] ..... B63H 21/17
(52) U.S. Cl. ..... 440/6; 440/3
(58) Field of Search ..... 440/3, 4, 6

(56) References Cited

U.S. PATENT DOCUMENTS

| | | | | | |
|---|---|---|---|---|---|
| 2,504,833 | A | * | 4/1950 | Hann | 440/6 |
| 3,230,698 | A | * | 1/1966 | Nettles | 60/718 |
| 3,904,883 | A | * | 9/1975 | Horwinski | 290/50 |
| 6,208,036 | B1 | | 3/2001 | Evans et al. | 290/46 |
| 6,396,161 | B1 | * | 5/2002 | Crecelius et al. | 290/36 R |

FOREIGN PATENT DOCUMENTS

| | | | | |
|---|---|---|---|---|
| DE | 296 04 437 | * | 7/1996 | |
| DE | 297 22 188 | * | 4/1998 | |
| JP | 3-197296 | * | 8/1991 | 440/3 |

OTHER PUBLICATIONS

"GM Hybrid–Electric Truck Technology," *AEI*, Nov. 2001. pp. 40, 42.

* cited by examiner

*Primary Examiner*—Sherman Basinger
(74) *Attorney, Agent, or Firm*—Leslie C. Hodges

(57) ABSTRACT

In an exemplary embodiment, a marine powertrain includes a flywheel motor generator (MG) directly driven by an engine to which a marine drive is also connected. The MG provides a 36 volt AC power output to charge a 36 volt battery to crank the engine for starting. The marine drive is connected to the engine output shaft through a hollow rotor of the MG. The 36 volt battery may be used directly to power 36 volt loads. Auxiliary 12 volt DC and 110 or 220 volt AC outputs may be provided. The motor generator can also provide sufficient electric power to support an electrically-driven hydraulic system capable of providing for power steering, trim and other auxiliary hydraulic functions. A selective cylinder deactivation system will allow the engine to operate in a more efficient mode for electric power generation and low power propulsion than with all the cylinders operating.

20 Claims, 4 Drawing Sheets

MARINE POWERTRAIN AND ACCESSORY POWER SYSTEM WITH FLYWHEEL MOTOR GENERATOR UNIT

TECHNICAL FIELD

This invention relates to marine powertrains and, more particularly, to a powertrain including a flywheel motor generator operative for battery charging and for engine starting and adapted for powering various accessory loads on a watercraft.

BACKGROUND OF THE INVENTION

It is known in the art relating to marine powertrains to provide a main engine directly connected through a stern drive or other marine drive unit driveably connected with a propulsion member such as a marine propeller. In a typical system for recreational and light commercial watercraft, the engine may be adapted from an automotive vehicle engine and generally includes a separate heat exchanger system, a belt driven generator connected to charge a 12 volt battery, an engine mounted starter powered by the battery and a controller for operating the system.

To provide power for lights and auxiliary loads such as air conditioning, refrigerator, range, electronic devices and accessories, a separate engine driven 110 or 220 volt AC power generator unit may be provided. A separate 12 volt auxiliary battery may be provided connected with a starter for the power generator engine and this battery may be charged through a converter charger from a 110 or 220 volt source, which may also be used to charge the main engine cranking battery. The auxiliary battery is used for 12 volt loads which may be utilized on the watercraft. The power generator engine typically requires a separate heat exchanger as well as separate fuel and exhaust lines in addition to those provided for the main engine.

SUMMARY OF THE INVENTION

The present invention provides a simplified marine powertrain which can avoid the need for a 110 or 220 volt auxiliary generator power unit and separate starter and generator members for the main engine. The powertrain includes a motor generator directly driven by the engine output shaft to which the stern drive or other marine drive unit is also connected. The motor generator provides an AC power output of a specified intermediate voltage (such as 36 volts) that provides adequate power for the intended uses. The output voltage is fed through an inverter to charge an intermediate voltage (36 volt) battery and to power electrical loads. The battery provides power through the inverter to drive the motor generator to crank the engine for starting.

In a preferred embodiment, the motor generator is formed as a so-called flywheel starter generator having a hollow rotor connected through a hub directly to the engine output shaft and mounted within a stationary housing connected to the engine block or frame. A stern drive unit may then be connected to the engine output shaft through the hollow rotor of the motor generator and may extend partially within the rotor if desired.

For operating various accessories on the associated watercraft, the 36 volt battery may be used directly to power 36 volt loads. In addition, a 36 volt to 12 volt DC-DC converter may draw power from the inverter or the 36 volt battery to charge a 12 volt battery useable for operating 12 volt loads on the vessel. Also, a 36 volt to 110 volt or 220 volt DC-AC converter may be operated from the 36 volt battery or the inverter to provide 110/220 volt power for operating AC loads for the various accessories used on the vessel. A system controller may control operation of engine and motor generator controls which may be integrated into an MG module, if desired, for controlling the operation of the various power devices.

By using a flywheel starter generator with a 36 volt or other intermediate voltage storage battery system on a marine vessel, with the motor generator powered by the primary propulsion engine, the following benefits may be realized.

A separate stand-alone 110 v/220 v engine generator with all its associated support systems may be eliminated.

A conventional belt-driven generator on the front of the engine is eliminated, improving packaging of the propulsion engine.

The 36 volt battery may be used to provide substantial electric power for a limited time with the engine off and will provide continuous electric power with the engine running at a low speed. Thus, the battery may act as a secondary source of propulsion power for a backup to the primary system if needed.

The engine and motor generator may also provide primary power for quiet low speed docking maneuvers powering high efficiency electric bow and stern thrusters.

The motor generator can also provide sufficient electric power to support an electrically-driven hydraulic system capable of providing for power steering, trim and other auxiliary hydraulic functions with the engine on or off. This eliminates an engine-driven mechanical pump and simplifies the typical task of marinizing the engine, reducing the boat builder's cost of various system installations.

The invention also eliminates the traditional marine starter, which is generally mounted in a location where maintenance is difficult.

For improved efficiency, while operating for power generation or low power propulsion, the engine may be provided with a selective cylinder deactivation system which will allow the engine to operate on fewer than all of its cylinders and provide necessary electric power with the engine running slowly in a more efficient mode than with all the cylinders operating.

These and other features and advantages of the invention will be more fully understood from the following description of certain specific embodiments of the invention taken together with the accompanying drawings.

DESCRIPTION OF THE PREFERRED EMBODIMENT

Figure 1:
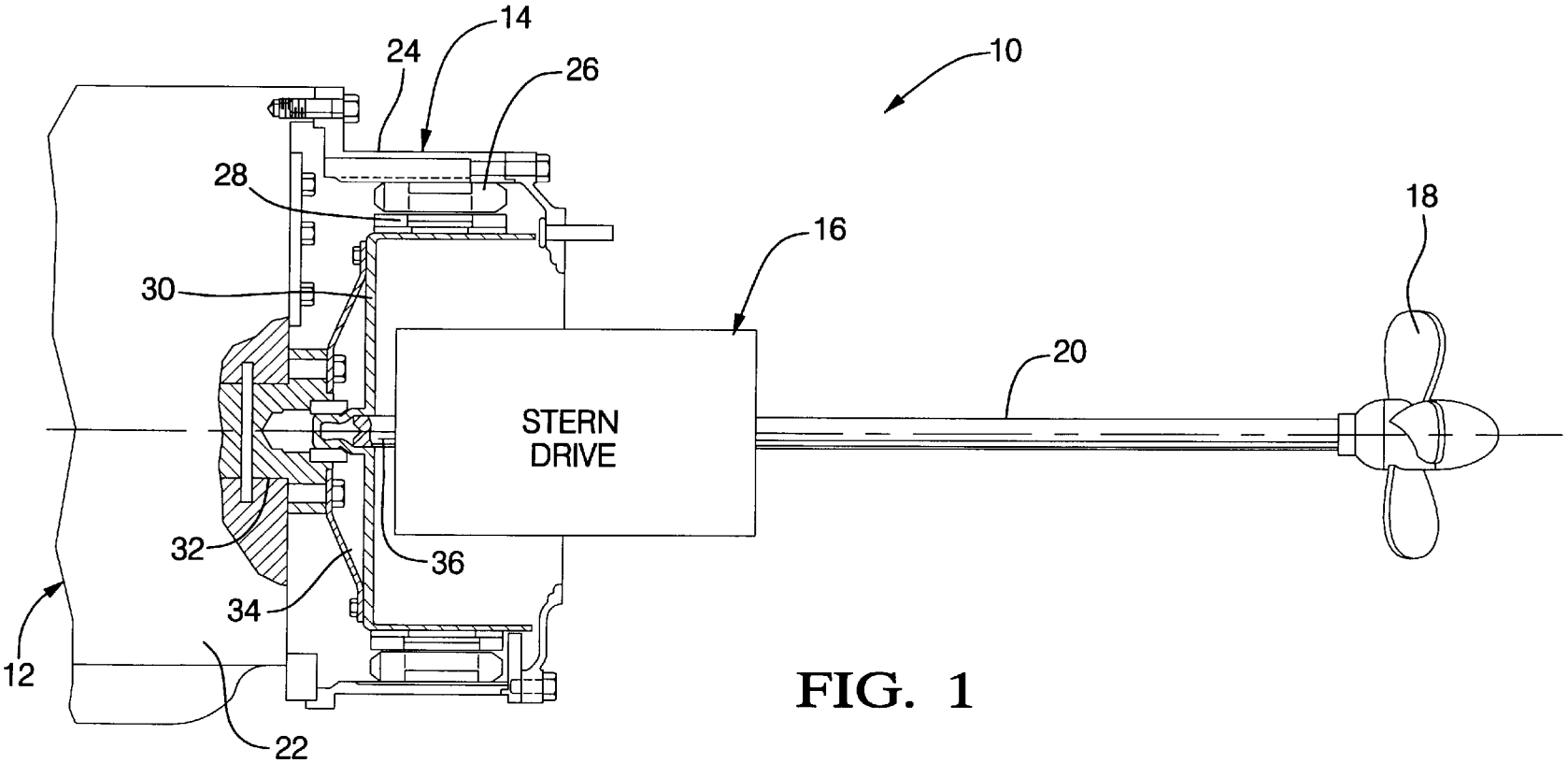
FIG. 1 is a view partially in cross section showing an exemplary marine powertrain in accordance with the invention.

Referring first to FIG. 1 of the drawings in detail, numeral 10 generally indicates a marine powertrain including an engine 12, a motor generator 14, a marine drive unit in the form of a stern drive 16, and a marine propeller 18 forming a propulsion member connected by a driveshaft 20 with the stern drive unit.

The engine 12 includes a cylinder block 22 at the rear end of which is mounted a motor generator housing 24 carrying a stator 26 of the motor generator. Within the stator, a rotor 28 of the motor generator is rotatably supported upon a hub 30 fixed to the end of a crankshaft 32 rotatably carried in the engine block 22.

The crankshaft 32 may also connect with a flex plate 34, or other alternative drive connection, that drives an input shaft 36 supported by the end of the crankshaft 32 for rotation therewith. Shaft 36 extends from the stern drive unit 16 which may extend into the hollow space formed within the hub and the surrounding rotor 28. The stern drive 16 conventionally contains reduction gears together with forward, reverse and neutral gear selections. The stern drive connects with the driveshaft 20 as an output shaft for driving the propeller 18 mounted at the outer end of the driveshaft so that the propeller is driven by the engine through a direct mechanical connection through the stern drive.

Figure 2:
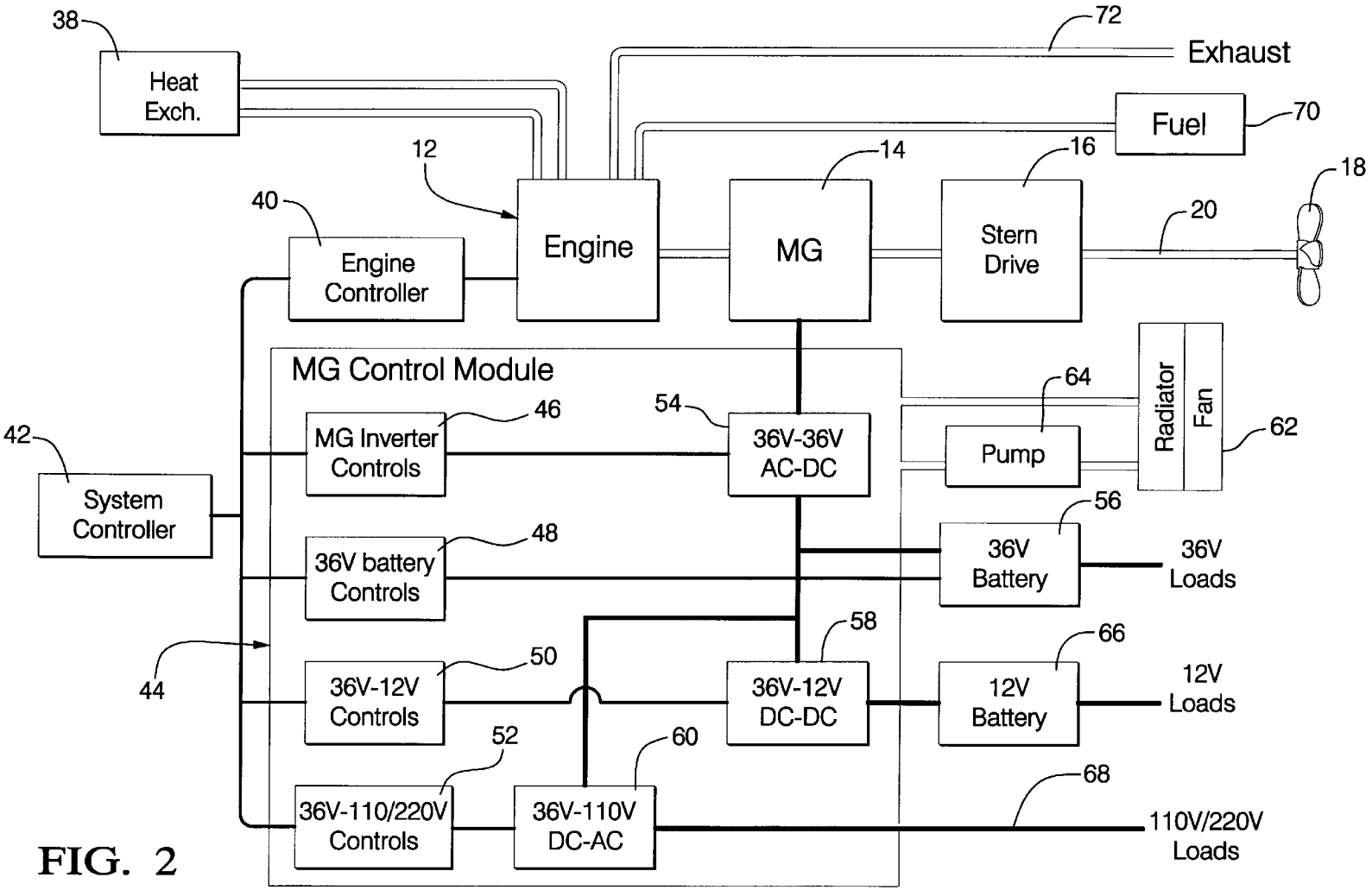
FIG. 2 is a schematic diagram of the exemplary marine powertrain including electrical auxiliaries in accordance with the invention.

Referring now to FIG. 2, an exemplary marine powertrain according to the invention is illustrated. The engine 12 is shown schematically as connected to the motor generator 14 and through the motor generator to the stern drive 16, which the driveshaft 20 connects with the propeller 18. A heat exchanger 38 is provided for controlling engine temperature by dissipating heat from the engine coolant in a conventional manner. An engine controller 40 controls the engine functions. A system controller 42 may be provided communicating with both the engine controller and a motor generator control module 44.

Module 44 may include suitable controls 46, 48, 50, 52 for controlling a 36 volt AC-DC inverter 54, a 36 volt intermediate voltage battery 56, a 36 v/12 v DC-DC converter 58 and a 36 v/110 v or 220 v DC-AC inverter 60, respectively. The AC-DC inverter 54 is connected electrically between the motor generator 14 and the 36 volt battery 56. The DC-DC converter 58 and the DC-AC converter 60 each connect to the 36 volt output of the AC-DC converter 54 as well as to the 36 volt battery 56. Heat generated in the control module 44 may be dissipated by a cooling system including a fan and radiator unit 62 and a separately powered pump 64 which circulates coolant between the radiator and module. The DC-DC converter 58 has a 12 volt output connected with a 12 volt battery 66 and the DC-AC converter 60 has a 110 or 220 volt output 68.

In operation of the system shown in FIG. 2, the engine is conventionally supplied with fuel from a fuel tank 70 and connects with an exhaust pipe 72 for carrying exhaust gases overboard. For starting the engine, power is supplied from the 36 volt battery 56 to the inverter 54 to power the motor generator 14 as a motor to rotate the engine crankshaft. After starting, the engine conventionally rotates the stern drive unit 16 to drive the propeller 18 in forward or reverse directions or in a neutral mode wherein the propeller is stopped.

While the engine is running, motor generator 14 acts as a generator supplying 36 volt alternating current to the inverter 54 where it is converted to DC and delivered to the battery 56, the DC-DC converter 58 and the DC-AC inverter 60. The 36 volt battery output may be used for driving accessories of the engine and the associated vessel which are adapted to operate on a 36 volt system. Similarly, the 12 volt battery 66 which is charged by converter 58 may in turn power 12 volt loads of the vessel or engine accessories that may have been designed for this voltage level. Finally, the output of the DC-AC converter may be directly connected to 110 volt AC loads including, for example, lights, refrigerator, range and various personal accessory items which may be available for use in the vessel.

Figure 3:
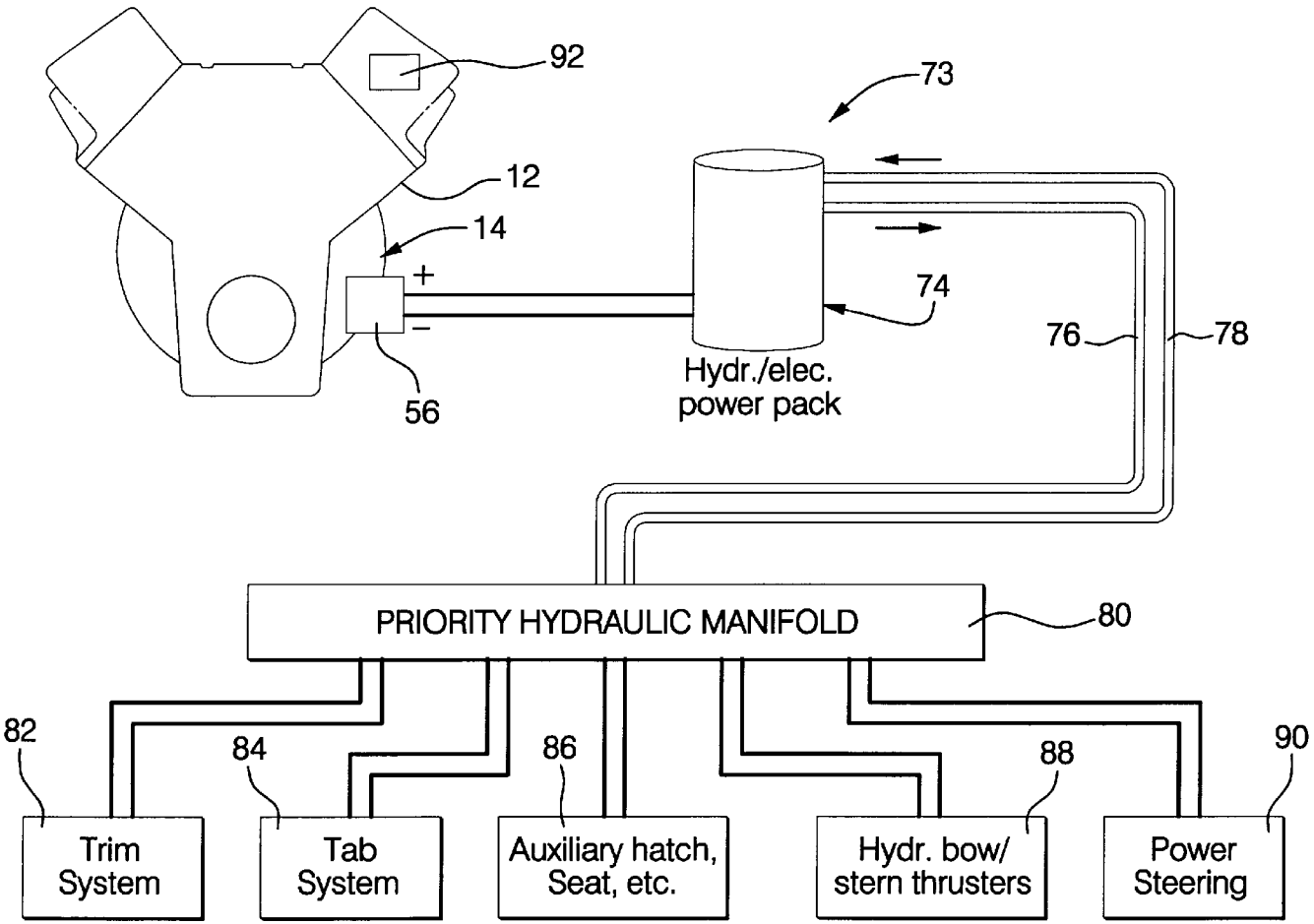
FIG. 3 is a schematic diagram indicating the application of an electrically-operated electrohydraulic system connected with the main battery of the marine powertrain and driving various accessories through a priority hydraulic manifold.

Referring now to FIG. 3, there is shown an exemplary electrohydraulic system 73 including a hydroelectric power pack 74 that is operated from the 36 volt output of the battery 56. Power pack 74 includes internally an electric motor driving a hydraulic pump, not shown, the latter being connected through hydraulic lines 76, 78 with a priority hydraulic manifold 80. The manifold in turn connects through hydraulic lines with a plurality of accessories including, for example, a trim system 82, a tab system 84, an auxiliary hatch 86, hydraulic bow and stern thrusters 88 and a power steering unit 90. Other power-operated devices could also be connected with the manifold 80. The operation of such a hydroelectric power pack for operating numerous hydraulic devices on a vessel is dependent upon the generation of substantial power by the 36 volt motor generator driven directly by the engine 12.

In operation of the electrohydraulic system 73, the power pack 74 is driven by the 36 volt battery output to rotate the internal pump, not shown, and provide pressurized hydraulic fluid to the priority hydraulic manifold 80. The various hydraulic devices are operated through separate controls as provided on the vessel. The hydraulic manifold 80 may include one or more pressure valves connected with the various auxiliary devices in order to distribute pressure on a priority basis to the most important of the auxiliary devices first and operate the remainder only when adequate pressure is available.

Thus, for example, the power steering unit 90 could be fed by a line which is operated at any suitable pressure available in the manifold. The trim and tab systems 82, 84 may, for example, be fed by lines having inlet control valves that open only when the manifold pressure is above a prescribed secondary pressure. The auxiliary hatch and any other attached accessories would be operated with a higher pressure valve so that these accessories could only be operated if there was adequate pressure in the manifold to operate all the other devices as needed.

In addition to the advantages indicated previously, the marine powertrain of the invention may be started quietly by the directly connected motor generator operated by alternating current power in contrast to the conventional DC-powered geared starter of conventional marine engine applications. Operation of the engine may also be made more efficient when a low power output is required, such as when operating the vessel at a slow rate in harbors or when docking and also when the engine is being used solely to generate electric power through the 36 volt generator. This may be accomplished by providing a cylinder deactivation system 92, FIG. 3, which acts within the engine by deactivating selected cylinders, leaving the engine to operate on the remaining cylinders. The engine may thereby be operated at a wider open throttle condition, which yields greater engine efficiency.

Figure 4:
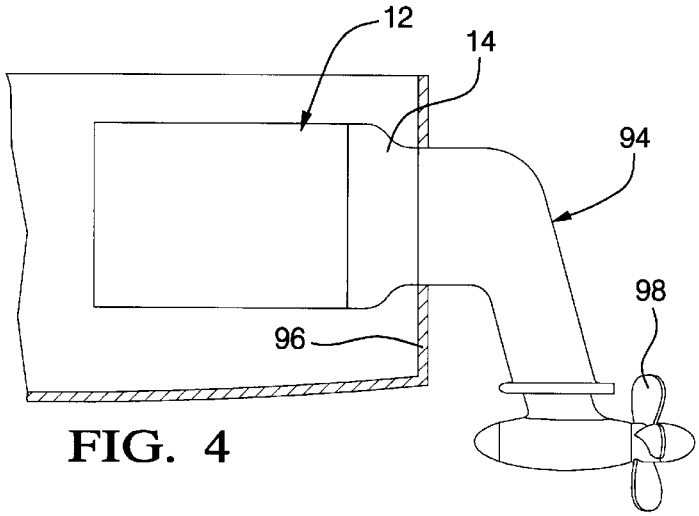
FIG. 4 is a partial cross-sectional view showing an alternative application of the invention to a boat with an outdrive.

It should be understood that the invention need not be limited as to form of the motor generator used or the type of marine drive in which it is incorporated. FIG. 4 illustrates an application of the engine 12 and motor generator 14 with an outdrive 94 of an inboard/outboard drive assembly. The engine and motor generator 12, 14 are located forward of the boat transom 96 on which the outdrive is mounted. The outdrive 94 houses the gear reduction and power transmission elements, not shown, which comprise a stern drive that is connected to the engine crankshaft for rotating the output propeller 98.

Figure 5:
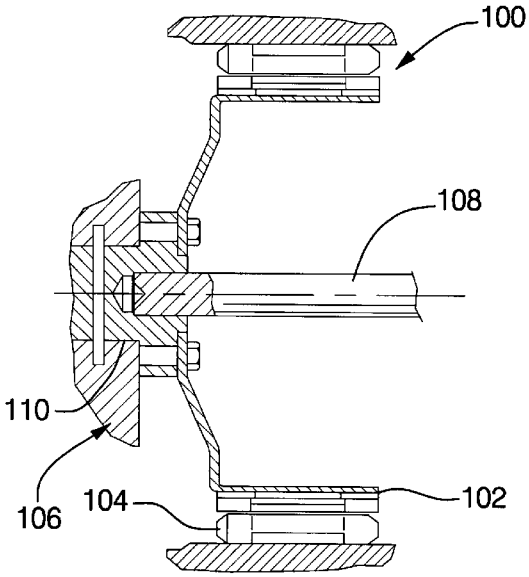
FIG. 5 is a cross-sectional view of an alternative drive connection for a motor generator with a hollow rotor.
Figure 6:
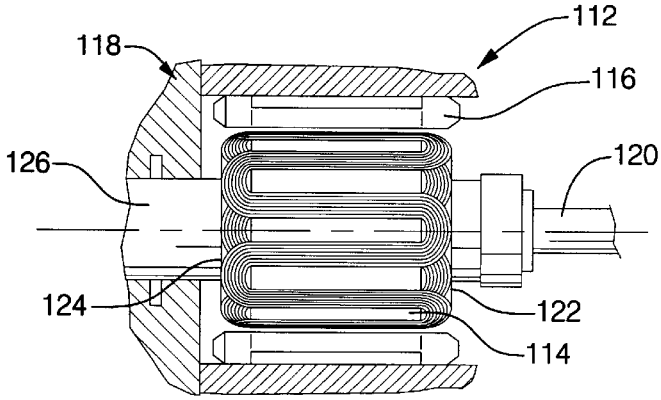
FIG. 6 is a view similar to FIG. 5 showing a drive connection for a drum-type rotor.

FIGS. 5 and 6 are examples of alternative motor generator (MG) arrangements that may be applied in accordance with the invention, although other suitable MG arrangements could also be used. In FIG. 5, the MG 100 has a hollow rotor 102 operable within a stator 104 fixed to the engine 106. A stern drive input member 108 extends through the rotor and connects directly to the engine crankshaft 110 where the MG rotor 102 is also connected. In FIG. 6, MG 112 has a drum-like rotor 114 operable within a stator 116 fixed to the engine 118. A stern drive input member 120 connects with an outer end 122 of the rotor while its inner end 124 is directly connected to the engine crankshaft 126.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A marine powertrain comprising:

an engine having a rotatable output member;

a motor generator continuously drivably connected with said output member;

a marine drive unit having an input continuously drivably connected with said output member;

a marine propulsion member drivably connected with an output of the marine drive unit;

an AC-DC inverter connecting an AC output of the motor generator with a DC intermediate voltage battery; and a system controller operative to control charging of the battery from the motor generator and starting of the engine with battery power to the motor generator.

2. A marine powertrain as in claim 1 wherein the controller is operative to control operation of the marine drive unit with battery power applied to the motor generator.

3. A marine powertrain as in claim 1 wherein the motor generator includes a stator mounted in fixed relation to the engine and a rotor driven by the output member and acting as a flywheel for the engine.

4. A marine powertrain as in claim 3 wherein said rotor is hollow and surrounds a connection of the marine drive unit with said output member.

5. A marine powertrain as in claim 3 wherein said rotor is connected between said marine drive unit and said output member.

6. A marine powertrain comprising:

an engine having a rotatable output member;

a motor generator drivably connected with said output member;

a marine drive unit drivably connected with said output member;

a marine propulsion member drivably connected with the marine drive unit;

an AC-DC inverter connecting an AC output of the motor generator with a DC intermediate voltage battery; and a system controller operative to control charging of the battery from the motor generator and starting of the engine with battery power to the motor generator;

wherein the engine includes variable displacement means for operating the engine with a reduced number of cylinders for increased efficiency when providing electric power.

7. A marine powertrain comprising:

an engine having a rotatable output member;

a motor generator drivably connected with said output member;

a marine drive unit drivably connected with said output member;

a marine propulsion member drivably connected with the marine drive unit;

an AC-DC inverter connecting an AC output of the motor generator with a DC intermediate voltage battery;

a system controller operative to control charging of the battery from the motor generator and starting of the engine with battery power to the motor generator; and a low voltage DC-DC converter connecting a low voltage battery with the intermediate voltage battery to charge the low voltage battery for operating low voltage loads of an associated watercraft.

8. A marine powertrain comprising:

an engine having a rotatable output member;

a motor generator drivably connected with said output member;

a marine drive unit drivably connected with said output member;

a marine propulsion member drivably connected with the marine drive unit;

an AC-DC inverter connecting an AC output of the motor generator with a DC intermediate voltage battery;

a system controller operative to control charging of the battery from the motor generator and starting of the engine with battery power to the motor generator; and a DC-AC inverter connected with the intermediate voltage battery to provide AC voltage for operating AC loads of appliances carried in an associated watercraft.

9. A marine powertrain comprising:

an engine having a rotatable output member;

a motor generator drivably connected with said output member;

a marine drive unit connected with said output member;

a marine propulsion member drivably connected with the marine drive unit;

an AC-DC inverter connecting an AC output of the motor generator with a DC intermediate voltage battery;

a system controller operative to control charging of the battery from the motor generator and starting of the engine with battery power to the motor generator; and a hydraulic electric power system connected with the AC-DC inverter and intermediate voltage battery, the power system including:

an electric motor electrically connected with the intermediate voltage battery and AC-DC inverter a hydraulic pump drivably connected with the electric motor for driving the pump;

a hydraulic manifold connected with the pump; and a plurality of selectively actuated hydraulic mechanisms connected to the manifold for actuation by hydraulic fluid from the manifold.

10. A marine powertrain as in claim 9 wherein said hydraulic mechanism include at least two of: a power steering system, a trim system, a tab system, an auxiliary system and a thruster system.

11. A marine powertrain as in claim 9 wherein the hydraulic manifold includes prioritized connections with said mechanisms whereby operation of selected mechanisms is cut off to maintain operation of at least one preferred mechanism under low hydraulic pressure conditions.

12. A marine powertrain comprising:

an engine having a rotatable output member;

a motor generator drivably connected with said output member;

a marine drive unit drivably connected with said output member;

a marine propulsion member drivably connected with the marine drive unit;

an AC-DC inverter connecting an AC output of the motor generator with a DC intermediate voltage battery;

a system controller operative to control charging of the battery from the motor generator and starting of the engine with battery power to the motor generator;

wherein the AC-DC inverter provides a 36 volt DC output, a DC-DC converter provides a 12 volt DC output from the 36 volt DC output, and a DC-AC inverter provides one of 110 and 220 volt AC outputs from the 36 volt DC output.

13. A marine powertrain as in claim 1 wherein the marine propulsion member is continuously drivably connected with an output of the marine drive.

14. A marine powertrain as in claim 13 wherein the engine includes variable displacement means for operating the engine with a reduced number of cylinders for increased efficiency when providing electric power.

15. A marine powertrain as in claim 13 including a low voltage DC-DC converter connecting a low voltage battery with the intermediate voltage battery to charge the low voltage battery for operating low voltage loads of an associated watercraft.

16. A marine powertrain as in claim 13 including a DC-AC inverter connected with the intermediate voltage battery to provide AC voltage for operating AC loads of appliances carried in an associated watercraft.

17. A marine powertrain as in claim 13 having a hydraulic electric power system connected with the AC-DC inverter and intermediate voltage battery, the power system including:

an electric motor electrically connected with the intermediate voltage battery and AC-DC converter inverter a hydraulic pump drivably connected with the electric motor for driving the pump;

a hydraulic manifold connected with the pump; and a plurality of selectively actuated hydraulic mechanisms connected to the manifold for actuation by hydraulic fluid from the manifold.

18. A marine powertrain as in claim 17 wherein said hydraulic mechanisms include at least two of: a power steering system, a trim system, a tab system, an auxiliary system and a thruster system.

19. A marine powertrain as in claim 17 wherein the hydraulic manifold includes prioritized connections with said mechanisms whereby operation of selected mechanisms is cut off to maintain operation of at least one preferred mechanism under low hydraulic pressure conditions.

20. A marine powertrain as in claim 13 wherein the AC-DC inverter provides a 36 volt DC output, a DC-DC converter provides a 12 volt DC output from the 36 volt DC output, and a DC-AC inverter provides one of 110 and 220 volt AC outputs from the 36 volt DC output.

* * * * *